United States Patent [19]

Kiess et al.

[11] 3,934,180

[45] Jan. 20, 1976

[54] METHOD OF REPRODUCING AN ELECTROSTATIC CHARGE PATTERN IN INTENSIFIED FORM

[75] Inventors: Helmut Gustav Kiess, Zurich, Switzerland; Albert Rose, Princeton, N.J.

[73] Assignee: RCA Corporation, New York, N.Y.

[22] Filed: Aug. 12, 1974

[21] Appl. No.: 496,717

[52] U.S. Cl. ..... 317/262 A; 250/326

[51] Int. Cl.[2] ..... G03G 13/00

[58] Field of Search ..... 317/262 A; 250/324–326; 96/1 C

[56] References Cited

UNITED STATES PATENTS

| | | | |
|---|---|---|---|
| 3,582,731 | 6/1971 | Sato et al. | 317/262 A |
| 3,873,310 | 3/1975 | Bean | 317/262 A |

*Primary Examiner*—J. D. Miller
*Assistant Examiner*—Harry E. Moose, Jr.
*Attorney, Agent, or Firm*—H. Christoffersen; R. P. Williams

[57] ABSTRACT

An original electrostatic charge pattern on an electrically insulating image-bearing surface is reproduced, on an electrically insulating film, in an intensified form by the steps of:

a. placing one surface of the film in contact with the original charge pattern on the image-bearing surface,
b. wiping, with a grounded wetted sponge, the other surface of the film to induce thereon a monopolar charge pattern of opposite polarity to that of the original charge pattern,
c. separating the film from the image-bearing surface and wiping, with a grounded wetted sponge, said one surface, whereby to induce a bipolar charge pattern on the film,
d. disposing said one surface of the film in contact with the image-bearing surface so that the electrostatic charge patterns of the same polarities contact each other and are in register with each other,
e. wiping, with a grounded wetted sponge, said other surface of the film to induce thereon a monopolar electrostatic charge pattern superimposed on the bipolar charge pattern, and
f. repeating the steps (c), (d), and (e), if necessary, until the reproduced electrostatic charge pattern on the film is of a desired intensity.

5 Claims, 7 Drawing Figures

METHOD OF REPRODUCING AN ELECTROSTATIC CHARGE PATTERN IN INTENSIFIED FORM

Figure 1:
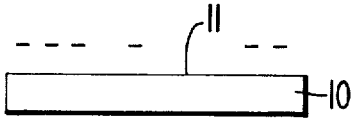

This invention relates to a method of reproducing, on an electrically insulating film, an electrostatic charge pattern in an intensified form conforming substantially in configuration to an original electrostatic charge pattern on an electrically insulating image-bearing surface. The novel method is particularly useful in the electrostatic and the electrophotographic printing arts for increasing the intensity of latent electrostatic images prior to their detection and/or development to render them visible.

The sensitivity of an electrophotographic or electrostatic printing process is limited by the charge density of electrostatic charge patterns (latent images) produced on an image-bearing surface of a recording element. The lower the charge density at which a photoconductor, for example, is operable, the lower is the number of photons needed to discharge the electrostatically charged photoconductor. A low charge density electrophototraphic process is, therefore, synonymous with high sensitivity electrophotography. On the other hand, the detection and/or the development of low charge density electrostatic charge patterns with a high resolution present serious difficulties. It is highly desirable, therefore, to intensify the latent electrostatic charge patterns prior to their further processing.

It has been proposed, in U.S. Pat. No. 3,766,634 for Apparatus for and Method of Reproducing an Electrostatic Charge Pattern, to reproduce, on a collector plate, an intensified electrostatic charge pattern of an original electrostatic charge pattern on an image-bearing surface with the aid of a transfer sheet. In this prior-art method both the transfer sheet and the collector plate have a plurality of discrete areas of electrically conductive material thereon, and an intensified electrostatic charge pattern is formed on the collector plate by periodically inducing charge patterns on the transfer sheet and transferring each of the induced charge patterns completely to the collector plate. While this prior-art method is useful for many applications, it requires a transfer sheet and a collector plate of special construction.

The novel method utilizes an electrically insulating film readily available on the commercial market, not requiring any special structure. Also, the novel method can be carried out manually with only a single electrically insulating film and without the need of a collector plate.

Briefly, the novel method of reproducing, on an electrically insulating film, an electrostatic charge pattern in an intensified form conforming substantially in configuration to an original electrostatic charge pattern on an electrically insulating image-bearing surface comprises the steps of:

a. placing one surface of the film into an area of influence of the original electrostatic charge pattern on the image-bearing surface, b. applying momentarily a source of charge migration to all areas of the other surface of the film, to induce a monopolar charge pattern thereon, c. removing the film from the image-bearing surface and applying momentarily a source of charge migration to all areas of said one surface of the film, to provide a bipolar charge pattern on said film, d. disposing said one surface of the film into an area of influence of the original electrostatic charge pattern on said image-bearing surface so that the electrostatic charge patterns of the same polarities on said film and on said image-bearing surface are in register, and e. applying momentarily a source of charge migration to all areas of said other surface of the film.

If the electrostatic charge patterns on the film are now of a desired intensity, they can be processed further, for example, as by detection and/or development. If, however, electrostatic charge patterns of greater intensity on the film are desired, the sequence of the aforementioned steps (c), (d), and (e), is repeated, one or more times, after the initial sequence of the steps (a)–(e), until the desired electrostatic charge density of the electrostatic charge patterns on the film is obtained.

Figure 2:
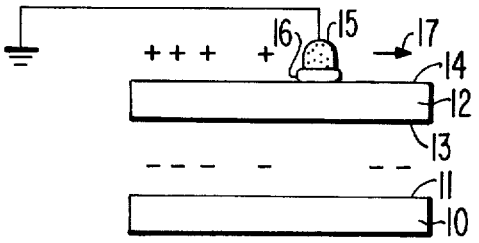
Figure 3:
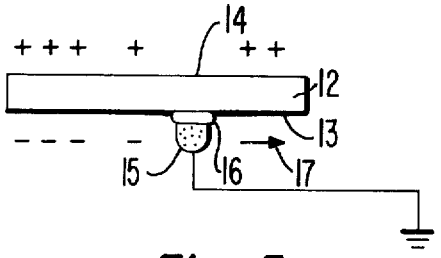
Figure 4:
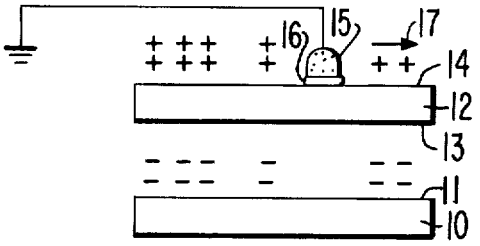
Figure 5:
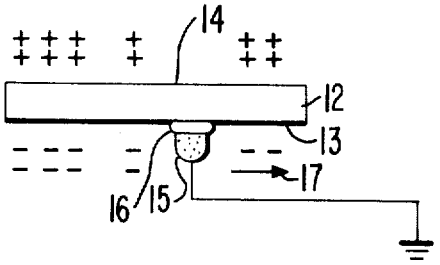
Figure 6:
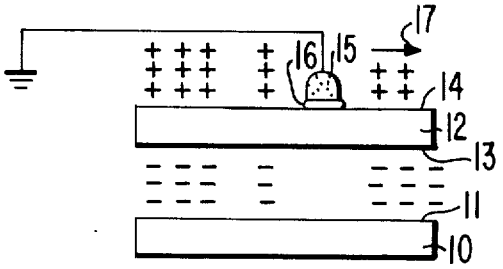
Figure 7:
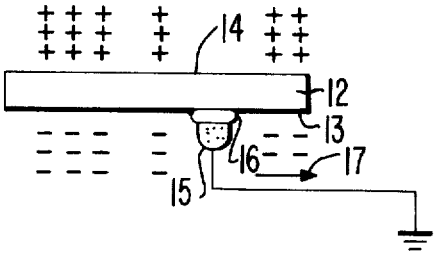

The novel method of the present invention will be explained with the aid of the accompanying drawing in which:

FIG. 1 is a side elevation of a recording element, having an electrically insulating image-bearing surface, and showing an original electrostatic charge pattern of negative polarity thereon;

FIGS. 2, 4, and 6 are schematic drawings of an electrically insulating film, in side elevation, in the area of influence of the original electrostatic charge pattern on the image-bearing surface shown in FIG. 1, and in the operation of inducing monopolar electrostatic charge patterns on the upper surface of the film; and FIGS. 3, 5, and 7 are schematic drawings of the electrically insulating film, in side elevation, in the operation of converting the monopolar charge patterns on the film to bipolar charge patterns.

Referring now to FIG. 1 of the drawing, there is shown a recording element 10 having an image-bearing surface 11 on which there is an original electrostatic charge pattern of negative electrostatic charges. It is, however, within the contemplation of the present invention for the original charge pattern to be of any polarity. The novel method of the present invention comprises a series of operations for reproducing the original monopolar charge pattern on the image-bearing surface 11 of the recording element 10 to an electrically insulating film 12, shown in FIGS. 2–7.

The original electrostatic charge pattern on the image-bearing surface 11 is a monopolar electrostatic image of either polarity, or it may comprise a monopolar charge pattern of opposite polarities. The monopolar charge pattern can be of the type induced on an insulating film from the surface of an electrophotographic recording element, comprising, for example, a layer of a photoconductor on a conductive backing, as employed in the electrophotographic art, and as described in the aforementioned U.S. Pat. No. 3,766,634. The recording element 10 can also be a sheet or film of electrically insulating plastic material, such as "MYLAR" (trademark of Dupont de Nemours), and the monopolar electrostatic charge pattern on the image-bearing surface 11 can be produced thereon by a method described in a copending patent application, Ser. No. 451,093, for a "METHOD OF ELECTROSTATIC RECORDING ON ELECTRICALLY INSULATING FILM BY NON-WETTING ELECTRICALLY CONDUCTIVE LIQUIDS," now U.S. Pat. No. 3,872,480, is issued on Mar. 18, 1975.

The electrostatic charge pattern on the image-bearing surface 11 may be of such a low intensity that it may be desirable to intensify a reproduction thereof so that it may be suitably detected and/or developed. The first step in the novel method of reproducing, on the film 12, the original charge pattern on the image-bearing surface 11 is to place the film 12 in an area of influence of the original charge pattern on the image-bearing surface 11. Preferably, one (lower) surface 13 of the film 12 is placed in direct intimate contact with the (upper) image-bearing surface 11 of the recording element 10. In the FIG. 2, as in FIGS. 4 and 6, the film 12 is shown spaced from the recording element 10 in order to show clearly the electrostatic charges on the adjacent surfaces of the recording element 10 and the film 12. In practice, however, it is preferable for the surface 13 of the film 12 to contact the image-bearing surface 11 of the recording element 10. It is, however, within the contemplation of the present method for the film 12 to be slightly spaced from the image-bearing surface 11, provided that the film 12 is within the area of influence of the original electrostatic charge pattern.

Means are provided to produce a monopolar charge pattern, on the other (upper) surface 14 of the film 12, of opposite polarity to that of the original electrostatic charge pattern on the image-bearing surface 11. To this end, a source of charge migration, such as a sponge 15 wetted with a conductive fluid or liquid 16 is electrically connected to a common electrical connection, such as a bias of ground potential, as shown in FIG. 2. The conductive liquid 16, such as water, methanol, or ethanol, for example, is substantially non-wetting on the film 12. Thus, with the lower surface 13 of the film 12 in intimate contact with the image-bearing surface 11 of the recording element 10, a monopolar (positive) electrostatic charge pattern is induced on the upper surface 14 of the film 12 by momentarily wiping all areas of the surface 14 with the grounded wetted sponge 15, as by moving the sponge 15 over the surface 14 in the direction of the arrow 17.

The electrically insulating film 12 is removed from the recording element 10, and the monopolar (positive) electrostatic charge pattern thereon is converted to a bipolar charge, as shown in FIG. 3, by moving the grounded wetted sponge 15 momentarily over all areas of the lower surface 13 of the film 12 in the direction of the arrow 17. Thus, as shown in FIG. 3, the film 12 now has a bipolar charge thereon and is, therefore, neutral to the outside world.

An additional monopolar (positive) electrostatic charge pattern is now superimposed over the bipolar charge pattern on the film 12, by the operation shown in FIG. 4. To this end, the lower surface 13 of the film 12 is placed in the area of influence of, and preferably in intimate contact with, the image-bearing surface 11 of the recording element 10 so that the electrostatic charge patterns of the same (negative) polarity are superimposed upon each other in register, and momentarily wiping all areas of the upper surface 14 with the grounded wetted sponge 15, in the direction of the arrow 17. The film 12, shown in FIG. 4, now has an additional (positive) monopolar electrostatic charge pattern added to the bipolar charge pattern on the film 12.

In the next operation, the monopolar electrostatic charge pattern on the film 12 is converted to a bipolar electrostatic charge pattern, as shown in FIG. 5. This is accomplished by separating the film 12 from the recording element 10, and moving the grounded wetted sponge 15 over all areas of the lower surface 13 of the film 12 in the direction of the arrow 17.

It will now be observed, looking at FIG. 5, that the upper and lower surface 14 and 13 of the film 12 are charged with electrostatic charge patterns of opposite polarity, respectively, and that the intensity of each electrostatic charge pattern is greater than that of the original electrostatic charge pattern on the image-bearing surface 11 of the recording element 10, shown in FIG. 1. If these electrostatic charge patterns on the upper and lower surfaces 14 and 13, respectively, of the film 12 are now of a desired intensity, they can be processed further in an electrostatic printing process as for example, by developing these charge patterns with suitable electroscopic toners.

If, however, it is desired to intensify the electrostatic charge patterns on the surfaces 13 and 14 of the film 12 further, the aforementioned steps of first adding a monopolar electrostatic charge pattern to the bipolar charge pattern, on the film 12, and then converting the monopolar charge pattern to a bipolar charge pattern can be repeated. Thus, by placing the film 12 over the recording element 10 so that the (negative) electrostatic charge patterns of the same polarity on adjacent surfaces thereof contact each other and are in register with each other as shown in FIG. 6, an additional monopolar (positive) charge is added to the electrostatic charge on the upper surface 14 by momentarily wiping all areas of the surface 14 with the grounded wetted sponge 15, in the direction of the arrow 17.

The film 12 is now separated from the recording element 10 and the additional monopolar (positive) electrostatic charge pattern on the surface 14 of the film 10 is converted to a bipolar charge by wiping all areas of the lower surface 13 with the grounded wetted sponge 15, in the direction of the arrow 17, as shown in FIG. 7. Thus, the electrostatic charge patterns on the opposite surfaces 13 and 14 of the film 12, as shown in FIG. 7, are intensified, in comparison to the charge pattern on these surfaces shown in FIGS. 1, 3, and 5. If charge patterns of still greater intensity are desired, the operations of adding a monopolar charge pattern to the previous bipolar charge pattern on the film 12, and then converting the additional monopolar charge pattern to a bipolar charge pattern can be repeated.

What is claimed is:

1. A method of reproducing, on an electrically insulating film, an electrostatic charge pattern in an intensified form conforming substantially in configuration to an original monopolar electrostatic charge pattern on an electrically insulating image-bearing surface, said method comprising the steps of:

a. placing one surface of said film into an area of influence of said original monopolar electrostatic charge pattern on said image-bearing surface, b. applying momentarily a source of charge migration to all areas of the other surface of said film, whereby to induce on said other surface a monopolar electrostatic charge pattern of opposite polarity to that of the original monopolar electrostatic charge pattern, c. removing said film from said image-bearing surface and applying momentarily a source of charge migration to said one surface of said film, whereby to induce an electrostatic charge pattern of the same polarity as that of said original monopolar electrostatic charge pattern thereon and to provide said film with a bipolar charge, d. disposing said one surface of said film adjacent to said image-bearing surface so that the electrostatic charge patterns thereon of the same polarities are in register with each other, and, e. applying momentarily a source of charge migration to all areas of said other surface of said film, whereby to induce on said other surface a monopolar electrostatic charge superimposed on said bipolar charge.

2. A method as described in claim 1 wherein:

the sequence of the steps (c), (d), and (e) are repeated after the initial sequence of the steps (a), (b), (c), (d), and (e), until a desired electrostatic charge density of the electrostatic charge patterns on said film is obtained.

3. A method as described in claim 1, wherein:

said electrically insulating film is a sheet of plastic material, said image-bearing surface comprises a surface of an electrostatic recording element, and the steps of applying momentarily a source of charge migration to all areas of said one or said other surface of said film comprises wiping said one or said other surface with an electrode connected to a source of reference potential.

4. A method as described in claim 3, wherein:

said electrode comprises a grounded wetted sponge, said sponge being wetted with an electrically conductive fluid that is substantially non-wetting on said film.

5. A method as described in claim 1, wherein:

the steps of placing one surface of said film into an area of influence of said original electrostatic charge pattern comprises placing said one surface of said film into intimate contact with said image-bearing surface.

* * * * *